US006955233B2

(12) United States Patent
Crowe et al.

(10) Patent No.: US 6,955,233 B2
(45) Date of Patent: Oct. 18, 2005

(54) ROLLER CONE DRILL BIT LEGS

(75) Inventors: John Ramsay Crowe, Scotland (GB); Angus Greig, Scotland (GB); Robert Hamilton, Scotland (GB); Gary Farquhar, Scotland (GB); Kevin Angus, Aberdeen (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/777,949

(22) Filed: Feb. 12, 2004

(65) Prior Publication Data

US 2004/0159470 A1 Aug. 19, 2004

Related U.S. Application Data

(62) Division of application No. 10/114,833, filed on Apr. 3, 2002.

(30) Foreign Application Priority Data

Apr. 27, 2001 (GB) ..... 0110401

(51) Int. Cl.[7] ..... E21B 10/50

(52) U.S. Cl. ..... 175/374; 175/425; 427/282

(58) Field of Search ..... 175/374, 425; 427/259, 272, 282; 148/210, 213, DIG. 100, DIG. 102, DIG. 103, DIG. 104, DIG. 105, DIG. 106

(56) References Cited

U.S. PATENT DOCUMENTS 4,694,918 A * 9/1987 Hall ..... 175/430
4,867,015 A * 9/1989 Kane et al. ..... 76/108.2
5,663,512 A * 9/1997 Schader et al. ..... 75/239
6,374,704 B1 * 4/2002 Scott et al. ..... 76/108.2

* cited by examiner

*Primary Examiner*—David Bagnell
*Assistant Examiner*—K. Thompson
(74) *Attorney, Agent, or Firm*—Osha Liang LLP

(57) ABSTRACT

A method is disclosed for applying hardfacing to a shirttail portion of a roller cone drill bit, including masking around the shirttail portion of the bit and operating a high pressure/high velocity oxygen fuel torch to apply the hardfacing to the shirttail portion.

10 Claims, 2 Drawing Sheets

ROLLER CONE DRILL BIT LEGS

CROSS-REFERENCE TO RELATED APPLICATIONS

This application is a divisional application of U.S. patent application Ser. No. 10/114,833 entitled "METHOD FOR HARDFACING ROLLER COVE DRILL BIT LEGS," filed Apr. 3, 2002.

BACKGROUND OF THE INVENTION

1. Field of the Invention

The invention relates generally to the field of drill bits used to bore holes through earth formations. More particularly, the invention relates to methods and structures for improving the durability of roller cone drill bits.

2. Background Art

Drill bits used to bore drill holes or wellbores through earth formations include roller cone bits. Typical roller cone bits include a bit body made from steel or similar material. The bit body includes one or more, and typically three, legs which depend from the bit body. The bit body is usually adapted to be threadedly or otherwise coupled to a drilling tool assembly ("drill string") which rotates the bit body during drilling. The legs include a bearing journal, onto each of which is rotatably mounted a roller cone. The roller cone includes a plurality of cutting elements disposed at selected positions about the surface of the cone. The cutting elements may be hard metal or composite inserts, milled steel teeth, or any combination thereof depending on the type of earth formation that is expected to be drilled with the particular drill bit.

In many types of roller cone bits, the roller cone is sealed with respect to the bearing journal to exclude fluids and debris from the wellbore from entering the bearing journal. The seal element is often an elastomer ring or similar device, while a lubricant filling the bearing surfaces on the journal is typically some form of petroleum based grease or the like. An exterior, exposed face of the bearing journal, outside of the volume sealed by the roller cone seal, is formed in various ways known in the art so as to maximize exclusion of cuttings and debris from the seal area. This exposed face is typically shaped so substantially conform to the curvature of the inside (bearing) surface of the roller cone, and is known in the art as a "shirttail" portion of the bit leg.

Typically the roller cones have sizes, and cutting elements arranged thereon, to substantially avoid contact between the wellbore wall and the shirttail portion of the leg. Further, the shirttail portion is itself shaped to minimize such contact during drilling of earth formations. In certain circumstances, such contact is difficult to avoid. Typical roller cone drill bits also include therein fluid discharge nozzles ("jets"), which provide a path for discharge of drilling fluid from the interior of the drilling tool assembly to cool, lubricate and clean the roller cones, and to lift formation cuttings out of the wellbore as the wellbore is being drilled. Often, such drilling fluid is circulated through the wellbore at high rates to enable adequate lifting of drill cuttings. In certain drilling operations, such as with drill strings which include steerable mud motors and the like, it has been observed that the shirttail portion of typical prior art roller cone drill bits is subject to high rates of erosion due to fluid flow past the shirttail, in addition to any abrasive wear which sometimes may result from the previously described wall contact.

Techniques known in the art for reducing wear on bit structures include attachment of hardface and/or superhard material inserts or similar structures into the wear prone areas. These type of wear resistance structures are not particularly effective in reducing wear caused by erosion because they only serve to prevent contact between surfaces. Techniques known in the art for reducing bit structure wear also include thermally applied hardfacing. Typical hardfacing thermal application techniques tend to raise the temperature of the applied-to structure so a degree which makes the use of such techniques impracticable for roller cone drill bits because of possible damage to the seals and lubricant, at least. Such techniques when used prior to assembly of the roller cones to the leg may also result in some changes to the fracture toughness of the leg material, and have therefore not been widely used. In many cases, erosion on the shirttail is not a problem, meaning that erosion damage to the shirttail occurs at such slow rates relative to wear of the bearing structure and cutting elements on the roller cones, as to make hardface application to the shirttail on all drill bits uneconomical.

It is desirable to have a technique for reducing wear on the shirttail portion of a roller cone drill bit which can be selectively applied to already assembled bits, and which minimizes possible damage to bit structures by its application.

SUMMARY OF INVENTION

One aspect of the invention is a method for applying hardfacing to a shirttail portion of a roller cone drill bit, including masking around the shirttail portion of the bit and operating a high pressure/high velocity oxygen (HP/HVOF) fuel torch to apply the hardfacing to the shirttail portion.

In some embodiments, the hardfacing is applied to a thickness of about 0.25 to 0.28 mm. In some embodiments, the torch is operated in a manner to limit the temperature of the shirttail portion of the bit to about 75 degrees C. In some embodiments, the roller cone drill bit comprises three shirttail portions, and the method includes operating the torch approximately ten to twelve times to apply the hardfacing to a first one of the roller cones. The operating the torch is repeated for a second one of the roller cones. The operating the torch is repeated for a third one of the roller cones. This application cycle is repeated two additional times.

Other aspects and advantages of the invention will be apparent from the following description and the appended claims.

DETAILED DESCRIPTION

Figure 1:
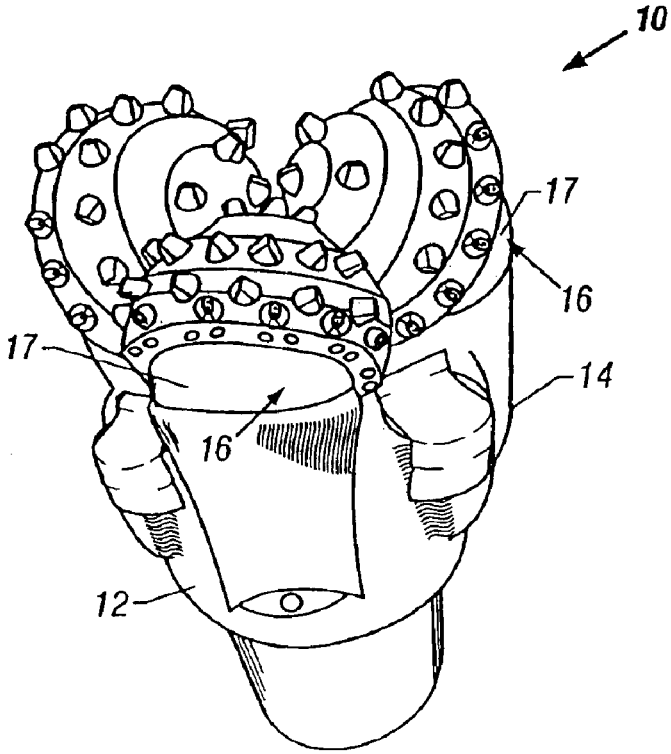
FIGS. 1 and 2 show a side view of a drill bit having hardfacing applied according to one embodiment of a method according to the invention.
Figure 2:
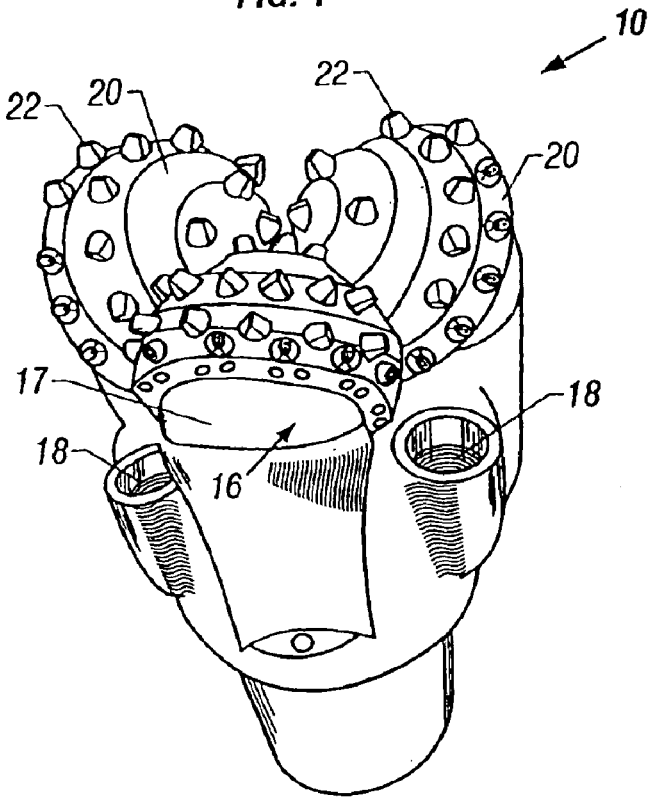

FIGS. 1 and 2 show a side view of a roller cone drill bit made according to one aspect of the invention. The drill bit 10 includes a bit body 12 made from steel or similar metal typically used for roller cone bit bodies. The bit body 12 includes one or more legs 14, and typically includes three such legs, depending from the bit body 12 as is conventional for roller cone drill bits. Each leg 14 includes a roller cone 20 rotatably mounted thereon. Each cone 20 is made from steel or similar metal known in the art for use as a roller cone. The roller cones 20 include thereon at selected positions, a plurality of cutting elements 22, which may be inserts, milled teeth or any other similar structure known in the art for use as a cutting element on a roller cone drill bit. The drill bit 10 also includes jets 18 inserted into appropriately formed recesses (not shown separately) in the bit body 12.

In a roller cone drill bit made according to one aspect of the invention, each leg 14 has thereon a hardface coating 16 applied to the exterior surface on an erosion-prone portion. Typically this erosion-prone portion will include a substantially semicircular portion including the rounded shirttail tip 17, but may include more or less of the shirttail 14 surface than is shown in FIGS. 1 and 2. The hardface coating 16 in a drill bit according to this aspect of the invention is formed from tungsten carbide, but may also be formed from other metal carbides which are known in the art for increasing the wear resistance of metals to which such hardface coating is applied.

In a method of making the bit according to one aspect of the invention, the hardface coating 16, including tungsten carbide or other metal carbide, is applied using a technique known in the art as high pressure/high velocity oxygen fuel spraying (HP/HVOF). Examples of other metal carbides include vanadium, chromium, titanium and combinations thereof. HP/HVOF spraying is advantageous when used to make roller cone bits according to the invention because the temperature of each leg surface to which the hardface coating 16 is applied increases in temperature only to about 70 to 75 degrees C. immediately after spraying. Such temperatures are well within the limits of typical seals and lubricants used in roller cone drill bits known in the art.

Figure 3:
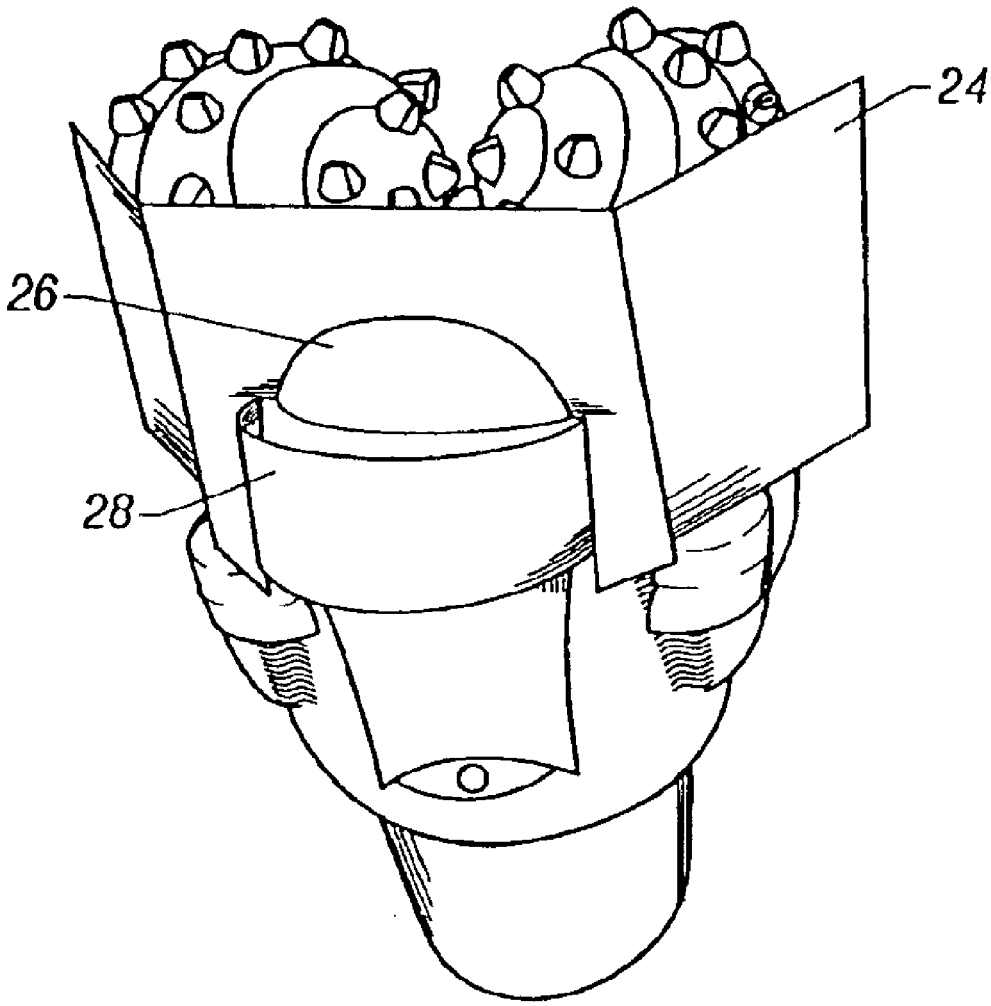
FIG. 3 shows one embodiment of a masking device used to limit application of hardfacing to only selected areas on a shirttail portion of a drill bit.

In one embodiment of a method of making a roller cone drill bit according to the invention, one of the legs on a drill bit having three such legs is masked, using a mask such as shown at 24 in FIG. 3. The mask 24 is adapted to shield the legs on the bit not being sprayed, and includes an opening therein, at 26, shaped to conform to the shirttail tip (17 in FIG. 2). The mask 24 may include an additional mask segment 28 to limit application of the hardfacing only to the lowermost portion of the leg (14 in FIG. 2), to the shirttail tip (17 in FIG. 2). The lowermost portion may be defined in some embodiments as bounded at one end by the shirttail tip (17 in FIG. 2) and at the other end by a line passing through the rotational center of the bearing journal and perpendicular to a longitudinal axis of the bit body.

In this embodiment, the HP/HVOF spray system is used to spray the masked leg (14 in FIG. 2) approximately 10 to 12 times. Then the mask 24 is applied to the next one of the legs to be hardfaced. The next one of the legs is then itself sprayed using the HP/HVOF spray system approximately 10 or 12 times. During application of the hardfacing to the next one of the legs, the leg that was first sprayed has some opportunity to cool. This is repeated until each of the legs on the bit has been sprayed approximately 10 or 12 times. After the first spraying cycle for each of the legs, the cycle is repeated. In this embodiment, the cycle is repeated three times so that the final thickness of the hardface coating (16 in FIG. 2) is in a range of about 0.1 to 0.6 mm thick. More preferably, the final thickness is within of about 0.25 to 0.28 mm. When this technique is used on single cone or two cone bits, it may be preferable to have a waiting period between spray cycles so that the temperature of each sprayed leg does not exceed about 75 degrees C. during spraying. Limiting the leg temperature will minimize any heat-caused damage to the seals and lubricant under the respective roller cone. One advantage of a method according to the invention is that is may be used on roller cone drill bits which are already assembled, as well as on unassembled bits.

A possible advantage of a drill bit made according to the present invention is that incidence of wear failure of a weld to a plug that seals a lock mechanism access hole (not shown) in the leg is avoided. Such wear failure has been known in the art to allow drilling fluid to enter the access hole, and consequently enter the bearing area and contaminate lubricant.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit, comprising:

a bit body adapted to be coupled to a drill string, the bit body including at least one leg depending therefrom, the leg having a bearing journal thereon, the leg defining a shirttail portion at an end thereof;

a roller cone having cutting elements thereon and rotatably affixed to the at least one bearing journal; and a hardface coating applied to the shirttail portion, the hardface coating applied by a high pressure/high velocity oxygen fuel torch, wherein the shirttail portion is bounded at one end by a shirttail tip and at the other end by a line passing through a center of the bearing journal and perpendicular to a longitudinal axis of the bit body.

2. The roller cone drill bit as defined in claim 1 wherein the hardface coating comprises tungsten carbide.

3. The roller cone drill bit as defined in claim 1 wherein the hardface coating has a thickness of about 0.1 to 0.6 mm.

4. The roller cone drill bit as defined in claim 1 wherein a thickness of the hardface coating is approximately 0.25 to 0.28 mm.

5. The roller cone drill bit as defined in claim 1 wherein the hardface coating is applied after assembly of at least one roller cone to the bit body.

6. The roller cone drill bit as defined in claim 1, the bit body including three legs depending therefrom.

7. The roller cone drill bit as defined in claim 1, wherein the hardface coating comprises a material that increases a wear resistance of a material of the shirttail portion to which the hardface coating is applied.

8. The roller cone drill bit as defined in claim 1, the cutting elements comprising at least one selected from the group consisting of hard metal inserts, composite inserts, and milled steel teeth.

9. The roller cone drill bit as defined in claim 1, wherein the hardface coating comprises a metal carbide.

10. The roller cone drill bit as defined in claim 9, the metal carbide comprising at least one selected from the group consisting of vanadium, chromium, and titanium.

* * * * *